US007806094B2

(12) United States Patent
Gruber

(10) Patent No.: US 7,806,094 B2
(45) Date of Patent: Oct. 5, 2010

(54) LASER IGNITION APPARATUS

(75) Inventor: Friedrich Gruber, Hippach (AT)

(73) Assignee: GE Jenbacher GmbH & Co. OHG, Jenbach (AT)

( * ) Notice: Subject to any disclaimer, the term of this patent is extended or adjusted under 35 U.S.C. 154(b) by 11 days.

(21) Appl. No.: 12/314,623

(22) Filed: Dec. 15, 2008

(65) Prior Publication Data

US 2009/0159031 A1 Jun. 25, 2009

(30) Foreign Application Priority Data

Dec. 19, 2007 (AT) ..... A 2062/2007

(51) Int. Cl.
*F02P 23/04* (2006.01)

(52) U.S. Cl. ..... 123/143 B; 372/109; 385/147

(58) Field of Classification Search ..... 123/143 B; 372/10, 12, 25, 69, 108, 109; 385/16, 31, 385/32, 50, 147
See application file for complete search history.

(56) References Cited

U.S. PATENT DOCUMENTS 6,796,278 B2 * 9/2004 Ryan, III ..... 123/143 B
7,114,858 B2 * 10/2006 Gupta et al. ..... 385/88
2006/0132930 A1 * 6/2006 Kopecek et al. ..... 359/718

FOREIGN PATENT DOCUMENTS

JP 58-165578 * 9/1983
JP 08-165978 6/1996
JP 09-250438 9/1997

OTHER PUBLICATIONS

Austrian Search Report (together with English translation) issued Jun. 23, 2008 in connection with A 2062/2007 corresponding to the present U.S. application.

* cited by examiner

*Primary Examiner*—Erick Solis
(74) *Attorney, Agent, or Firm*—Wenderoth, Lind & Ponack, L.L.P.

(57) ABSTRACT

An apparatus is provided for the ignition of a fuel/air mixture in the combustion chamber of a combustion machine, wherein the combustion chamber has at least one inlet valve and at least one outlet valve. There are further provided a laser light generating device for giving off laser light and a combustion chamber window for coupling the laser light into a combustion chamber of the combustion machine. There is provided at least one fluid feed means which is separate from the inlet valve or valves and with which a fluid can be caused to flow at least on to regions of the surface of the combustion chamber window or between the combustion chamber window and the focal point of the laser light.

18 Claims, 5 Drawing Sheets

LASER IGNITION APPARATUS

BACKGROUND OF THE INVENTION

The invention concerns an apparatus for the ignition of a fuel/air mixture in the combustion chamber of a combustion machine, wherein the combustion chamber has at least one inlet valve and at least one outlet valve. There are further provided a laser light generating device for giving off laser light and a combustion chamber window for coupling the laser light into a combustion chamber of the combustion machine. The invention further concerns a method of operating a combustion machine, in particular a gas engine, using a laser light generating device which introduces laser light into a combustion chamber of the combustion machine, wherein the laser light generating device has a combustion chamber window by way of which the laser light is introduced into the combustion chamber. Finally the invention concerns a combustion machine having an apparatus of the aforementioned kind.

Laser ignition is an ignition system which is in the course of development for combustion machines operated on the basis of the Otto cycle, which is based on the principle that an intensive laser pulse in the combustion chamber of the combustion machine is concentrated on to a focal point, whereby the extremely high field strengths of the laser light beam which occur in the focal point or at the focus cause the gas to be ionised and consequently heated to plasma temperatures (several thousand degrees Kelvin). Due to focusing of the laser light beam on the focal point, the ignition spark or sparks is or are generated there. The resulting plasma spark ignites the fuel/air mixture in a similar manner to conventional spark ignition in which the spark is produced by electrical flashover between two electrodes.

There are different concepts for producing the laser light pulse. A preferred concept provides that the ignition laser which produces the ignition pulse is longitudinally pumped by means of a pump light source (for example a semiconductor laser) by way of an optical fiber until the activation energy reaches a level required for starting and delivery of the ignition laser pulse. The beam of the pulse laser is introduced into the combustion chamber by way of a suitable optical means comprising a focusing device and a transmission window (combustion chamber window). The optical coupling-in means for coupling the laser pulse into the combustion chamber of the engine comprises a suitable lens system and what is referred to as the combustion chamber window representing the last optical element before the beam passes into the combustion chamber.

The advantage of laser ignition over conventional spark ignition is inter alia that the ignition spark can be placed freely in the depth of the combustion chamber where optimum ignition conditions prevail. In contrast thereto, combustion initiation with conventional spark ignition occurs in the immediate proximity of the combustion chamber wall, wherein the flat electrodes delimiting the ignition spark impede formation of the flame core. The energy of the laser spark can be greatly increased by increasing the power of the laser system without thereby involving increased wear as occurs with spark ignition in regard to electrode wear.

A further advantage of laser ignition is that with increasing engine power output the minimum pulse energy required (which is that energy of the plasma spark, that is required at a minimum to ignite the fuel/air mixture) decreases. In comparison, the conventional spark ignition systems with the engine power outputs planned in future noticeably encounter their system limits. Particularly in the case of large-scale static engines, preferably gas engines which in the present case represent a preferred area of use, ongoing use both of the engine and also the ignition apparatus must be possible, with long service lives, in order to keep stoppage times (for example, for replacing ignition systems) as short as possible.

The major problems in terms of designing and mass-production implementation of laser ignition include inter alia ensuring or maintaining the optical properties of the combustion chamber window over the service life of the combustion machine. Especially in relation to the combustion chamber-side interface of the combustion chamber window, high thermo-chemical loadings and the deposit of solid residues from combustion can lead to clouding of the surface, whereby the beam is attenuated, (that is to say partially absorbed and also scattered), which either leads to a considerable reduction in the energy of the plasma spark or leads to failure of the plasma spark.

That problem is usually combated by on the one hand providing reserves for losses and attenuation effects due to the service life by means of high levels of pulse energy and on the other hand producing the high levels of pulse power to afford an effect of burning the window surface free. The disadvantage of that procedure lies in the considerable increase in costs for the required high laser power output and in the high specific loading on the surface at which the window is burnt free.

SUMMARY OF THE INVENTION

Therefore the object of the present invention is to provide an apparatus of the kind set forth in the opening part of this specification and a method of the kind set forth in the opening part of this specification, with which the disadvantages of the state of the art are reduced. In particular, the invention aims to reduce deposits in the combustion chamber-side region of the combustion chamber window.

That object is attained by the features of the device claims or method claims.

There is therefore provided an apparatus for the ignition of a fuel/air mixture in the combustion chamber of a combustion machine, wherein the combustion chamber has at least one inlet valve and at least one outlet valve. A laser light generating device is provided for giving off laser light, and a combustion chamber window is provided for coupling the laser light into a combustion chamber of the combustion machine. At least one fluid feed device is separate from the inlet valve or valves and by which a fluid can be caused to flow at least on to regions of the surface of the combustion chamber window or between the combustion chamber window and the focal point of the laser light. In addition, there is provided a method of operating a combustion machine, in particular a gas engine, using a laser light generating device which introduces laser light into a combustion chamber of the combustion machine. The laser light generating device has a combustion chamber window by way of which the laser light is introduced into the combustion chamber. In operation of the combustion machine, a fluid separate from the fuel is passed on to the combustion chamber window or between the combustion chamber window and the focal point of the laser light.

It is possible with the apparatus according to the invention to cause a fluid to flow continuously on to the combustion chamber window and more specifically at the interface of the combustion chamber window, at the combustion chamber side, or between the focal point and the combustion chamber window so that deposits formed by combustion of the fuel/air mixture cannot be deposited at the combustion chamber window. In that way, the combustion chamber window is kept free of deposits at the combustion chamber side and the laser can be operated with a lower level of power as there is no interference absorption due to deposits on the combustion chamber window. There is also no need for the laser to be operated at a power level which burns free or removes again the deposits on the combustion chamber window. Overall, that measure greatly increases the service life of the entire apparatus. The method according to the invention makes it possible for the fluid to be caused to flow on to the combustion chamber window (more specifically on to the interface thereof, that is at the combustion chamber side) or the region between the combustion chamber window and the focal point of the laser light. It is desirably provided that the fluid involves no or only minimal interactions with the laser light so that in the preferred case the fluid is a gas, particularly preferably air or an inert gas. In the present case it is sufficient as an inert gas if the interaction with the laser light does not result in a chemical reaction. With a fuel/air mixture in the correct mixture ratio, the interaction leads to an ignition effect so that such a fluid would be unsuitable while air which in the conventional sense cannot be considered to be an inert gas by virtue of the high oxygen content can in the present case certainly be an inert gas as air generally is not caused to react with laser light alone or is caused to react only to a slight extent which does not cause any problem. Overall that depends on the laser light aspect, for example the levels of light intensity, wavelengths and pulse durations, so that the average man skilled in the art is in a position to select a suitable fluid. By way of example, $CO_2$, nitrogen, noble gas or mixtures thereof would be considered as the inert gas. A low degree of light absorption by the fluid can be tolerated.

By virtue of the high pressures in the combustion chamber, it is preferably provided that the fluid—preferably gas—is caused to flow thereinto under a pressure which is above the induction pressure or filling pressure of the combustion chamber. In the ideal case, the increased pressure is at least 1 bar above the induction pressure. Such a choice for the pressure makes it possible to counteract the high pressures in the combustion chamber so that the diffusion of the combustion residues towards the combustion chamber window can be reduced to a high degree.

It is desirably provided that the fluid feed device has at least one fluid outlet opening. It is possible in that way for the flow of the fluid to be guided into the desired regions through one or more specifically targeted fluid outlet opening or openings.

It can further be provided that the fluid feed device has a valve for fluid metering. The amount of fluid can be optimally metered by a valve. In the situation where the valve is in the form of a check valve, a reverse flow of gases out of the combustion chamber is prevented. In the situation where the valve is in the form of a metering valve, the amount and the pressure of the fluid can be regulated in the optimum fashion.

It is particularly preferably provided that the apparatus has a prechamber arranged in a region between the combustion chamber window and the focal point of the laser light. The region into which the fluid is caused to flow between the combustion chamber window and the focal point can be spatially optimally regulated by that measure. In addition, the gas flow out of the combustion chamber towards the combustion chamber window is reduced by virtue of the spatial delimitation. In that respect, it is advantageously provided that the prechamber is arranged between the combustion chamber window and the focal point of the laser light, whereby the region through which gas fluid flows is clearly defined. It has been found that such a prechamber reduces the amount of fluid required and optionally the feed of fluid can also be interrupted at times in operation.

In an embodiment, it is provided that the apparatus has a further prechamber which encloses at least the region of the first prechamber. In that respect it is possible once again to distinguish between two advantageous variants. In the first case, the second prechamber serves to even better shield the first prechamber from the gas flow out of the combustion chamber and to reduce a turbulent flow. In the second case, a fluid can be introduced into the second prechamber. In that case, in a further variant, it can be provided that the fluid which can be introduced into the second prechamber is an air/fuel mixture which preferably has a lower lambda $\lambda$ (ratio of air to fuel) than the lambda $\lambda$ in the combustion chamber. In that way, the second prechamber region with a higher fuel content can be used for preignition which then initiates actual ignition of the lean mixture in the combustion chamber. In that respect, the focal point of the laser light is arranged in the edge region or in the central region of the second prechamber.

The proposed solution according to the invention is based in particular on the notion that the combustion chamber window is not directly exposed to the combustion gases but is separated from the combustion gases by a fluid cushion—in the simplest case an air cushion. In that case, the laser beam, after passing through the combustion chamber window, can be passed through a (for example) cylindrical prechamber which is flushed with fluid (for example air). The focal point of the beam path is in front of or in the transitional region of the prechamber to the main combustion chamber or is already directly in the main combustion chamber. The prechamber can be flushed with fluids such as compressed air or with another suitable inert gas during the charge change phase of the cylinder.

Accordingly, it is desirable if the flushing gas supply pressure is markedly above the induction pressure or filling pressure of the engine (for example >1 bar above the induction pressure).

By virtue of that measure on the one hand the combustion chamber window is blown clear and cooled between the working strokes while on the other hand due to the presence of an air cushion the combustion chamber window is protected from the action of the flame or the hot combustion gases. The combustion residues can thus no longer be deposited at the surface of the window, or can be so deposited only to a much lesser degree.

BRIEF DESCRIPTION OF THE DRAWINGS

Further advantages and details of the invention will be apparent from the Figures and the specific description. In the Figures in cross-section.

DETAILED DESCRIPTION OF THE INVENTION

Figure 1:
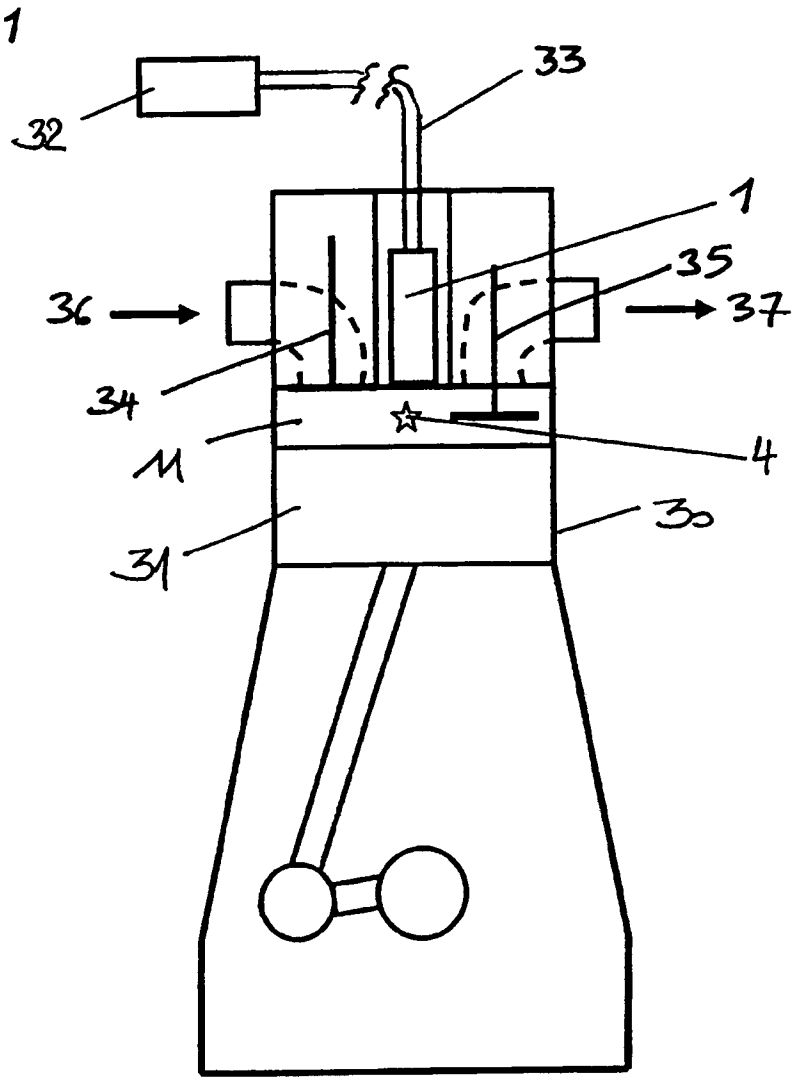
FIG. 1 shows an overview of a cylinder of a combustion machine with a laser light generating device.

FIG. 1 shows a highly diagrammatic overview of a cylinder 30 of a combustion machine having a piston 31 of per se known structure. The piston compresses fuel which is let in by way of the inlet 36 and the inlet valve 34, in the combustion chamber 11 of the cylinder 30. A laser light generating device 1 produces an ignitable laser beam which produces an ignition spark at the focal point 4. The laser light generating device 1 is pumped by a pump light source 32 and by way of an optical fiber 33 until a suitable laser pulse is delivered into the combustion chamber 11 for ignition of the fuel/air mixture. After ignition of the fuel/air mixture, the burnt gas is expelled from the combustion chamber 11 by way of the fuel outlet 37 and the outlet valve 35.

Figure 2:
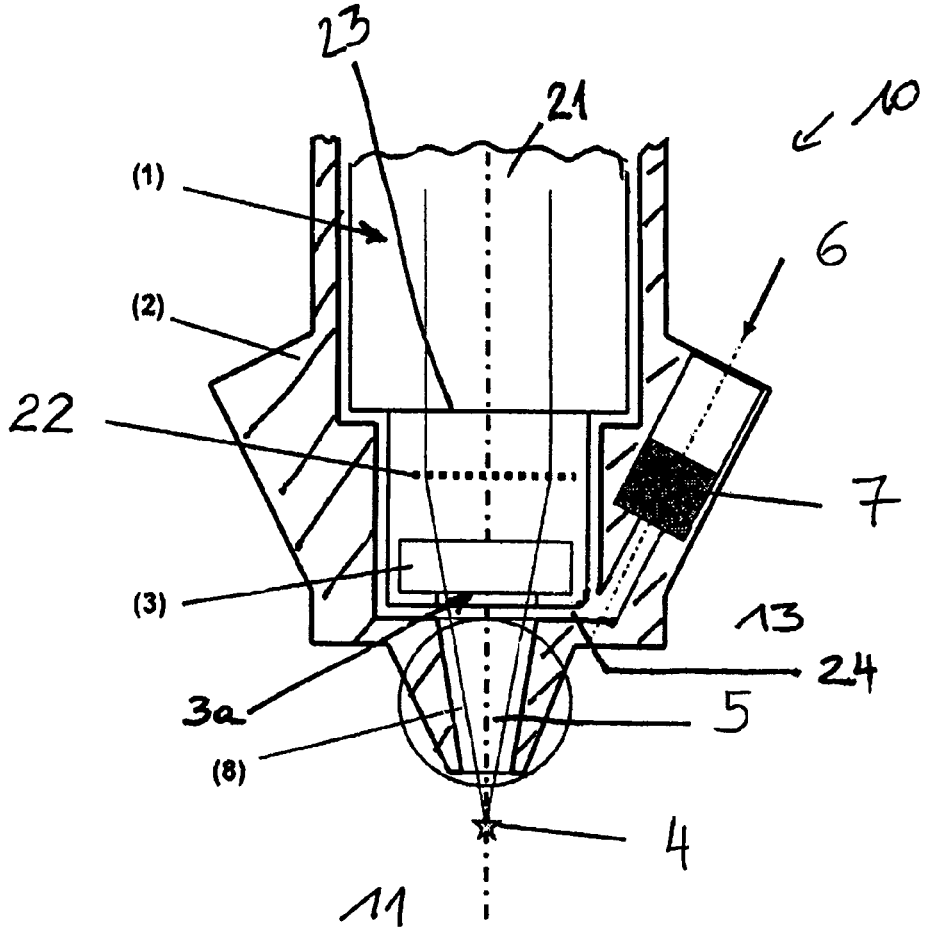
FIG. 2 shows a first embodiment of an apparatus with a single prechamber.

FIG. 2 is a diagrammatic cross-section through the front portion of an embodiment of an apparatus where a laser light generating device (laser spark plug) 1 is fitted, preferably screwed, into a prechamber sleeve 2. The laser light generating device 1 is designed as is known per se so that the known parts will be only briefly considered at this juncture. The resonator 21 which is fed by a pump light source (not shown) has (shown at the bottom in FIG. 2) a coupling-out mirror 23 by way of which the laser light 8 (shown in the form of outer boundary rays) is coupled out of the resonator 21 to the focusing device 22. The focusing device 22 (here indicated in simplified form by means of the optical axis) can be a lens or a lens system and focuses the laser light 8 on to the focal point 4 which here coincides with the ignition point at which the plasma spark is formed.

A prechamber sleeve 2 encloses the laser spark plug 1 except for the beam path 8 of the laser light pulse. Instead of a separate prechamber sleeve 2, it is also possible for the cylinder head of the combustion machine at the location of the laser light entrance to be in the form of a prechamber. The free cross-section in the beam path of the laser light 8 is the prechamber 5 which here narrows in the direction of the combustion chamber 11. The prechamber 5 is here therefore a kind of truncated pyramid, the focal point 4 here being just outside the prechamber 5. The prechamber 5 in the present case also extends between the prechamber sleeve 2 and the laser light generating device 1 approximately in the form of a gap to the fluid feed device 10. In that way, a lateral passage 24 is formed. The fluid (for example compressed air) is introduced into the prechamber 5 by way of a feed bore 6 (in the drawing, from the side at top right towards bottom left). The provision of a valve 7, for example a check valve (shown here) or a cyclically controlled solenoid valve in the feed bore, prevents a return flow during the compression and working strokes. The fluid flow takes place in the illustrated embodiment along the lateral passage 24 or the gap between the laser light generating device 1 and the prechamber sleeve, more specifically in such a way that a fluid flow can be caused to flow in between the interface 3*a*, at the combustion chamber side, of the combustion chamber window 3 and the focal point 4.

The plasma spark is formed at the focal point 4. Here in the illustrated embodiment, the focal point 4 is shown outside the conical prechamber 5, but in principle the plasma spark could also be ignited within the cone as the prechamber 5 is filled region-wise with fuel/air mixture in the front region, in particular in the region at the combustion chamber side, depending on the pressure due to the compression stroke of the piston.

The advantage of positioning the plasma spark outside the prechamber 5 in conjunction with the specific configuration of the prechamber 5 is that high-energy radicals generated by the laser pulse in the plasma drift away from the prechamber 5 due to the flow components of the cylinder charge (for example swirl and/or squish surface flow) and thus can no longer reach the combustion chamber window 3.

Figure 3:
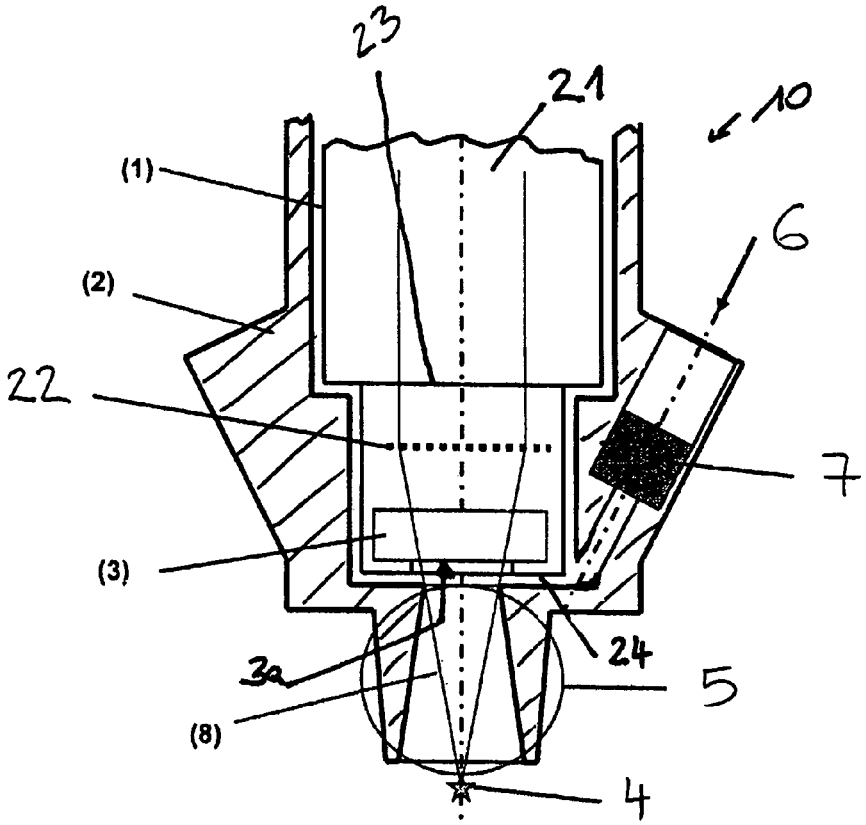
FIG. 3 shows a further embodiment of an apparatus with a single prechamber but of different geometry.

FIG. 3 shows a modification of the variant of FIG. 2, wherein the shape of the prechamber 5 is turned through 180°. As the components of FIGS. 2 through 5 are substantially identical, the features already described with reference to FIG. 1 will not be discussed in detail again here but instead attention is directed to FIG. 2. In the embodiment of FIG. 3, the prechamber 5 enlarges from the inside (that is to say from the combustion chamber window 3 in the direction of the main combustion chamber), and therefore represents a truncated pyramid in the reverse direction. In other words, the smaller boundary surface of the truncated pyramid is oriented towards the combustion chamber window 3. In this embodiment, the focal point 4 and therewith also the plasma spark could without detriment to flame propagation be displaced further inwardly, that is to say into the prechamber 5. The advantage of that arrangement is enjoyed in particular in relation to laser concepts where a plurality of spatially separate plasma sparks or focal points 4 are produced by way of one and the same optical coupling-in means 22.

Figure 4:
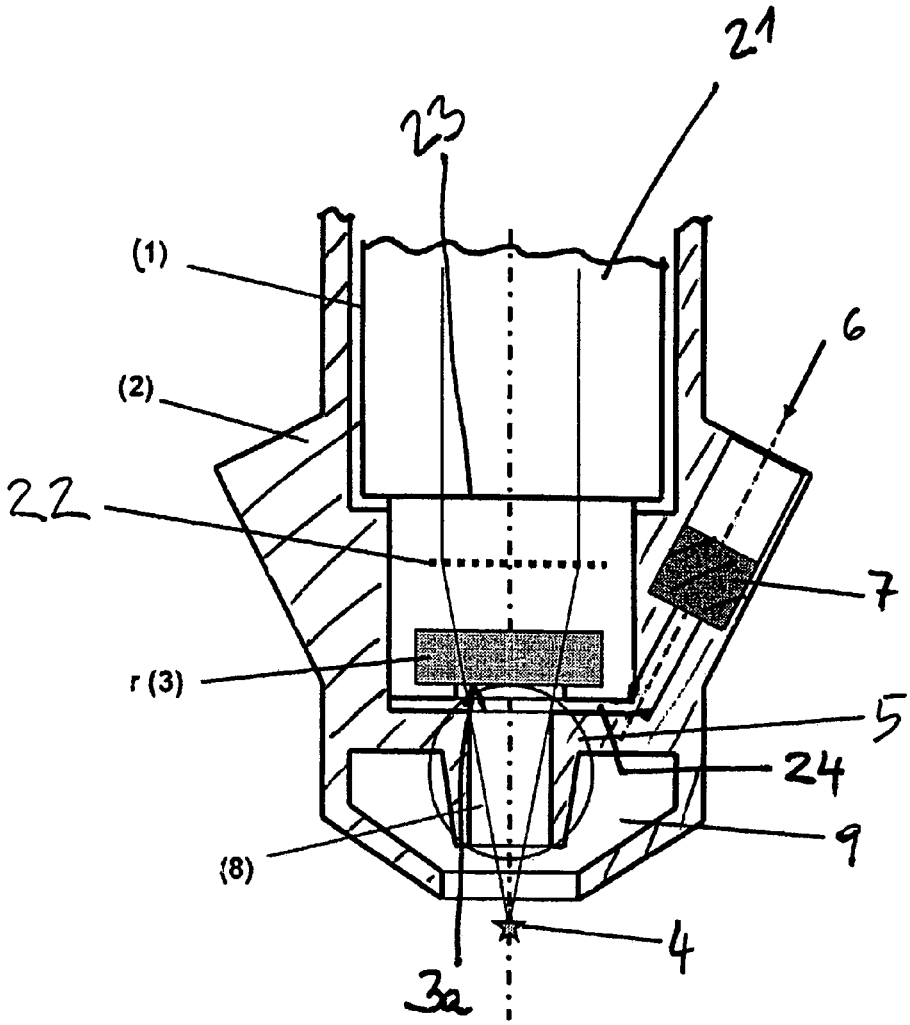
FIG. 4 shows a first embodiment of the apparatus with two prechambers.

FIG. 4 shows an embodiment having two prechambers 5, 9. The inner chamber 5 corresponds to the prechamber 5 of the variant of FIG. 2 or FIG. 3. It substantially shields the combustion chamber window 3 or the interface 3*a*, at the combustion chamber side, of the combustion chamber window 3 from the flame front or the combustion gases, by fluid flushing occurring at the inner prechamber 5. The outer chamber 9 serves for optimization of mixture ignition and flame advance, wherein a prechamber effect is achieved by defined conditions in respect of the temperature and the flow conditions in that part. The plasma spark can be placed at an optimum position in a specifically targeted fashion (within, at the opening of or outside the inner or outer prechamber).

Figure 5:
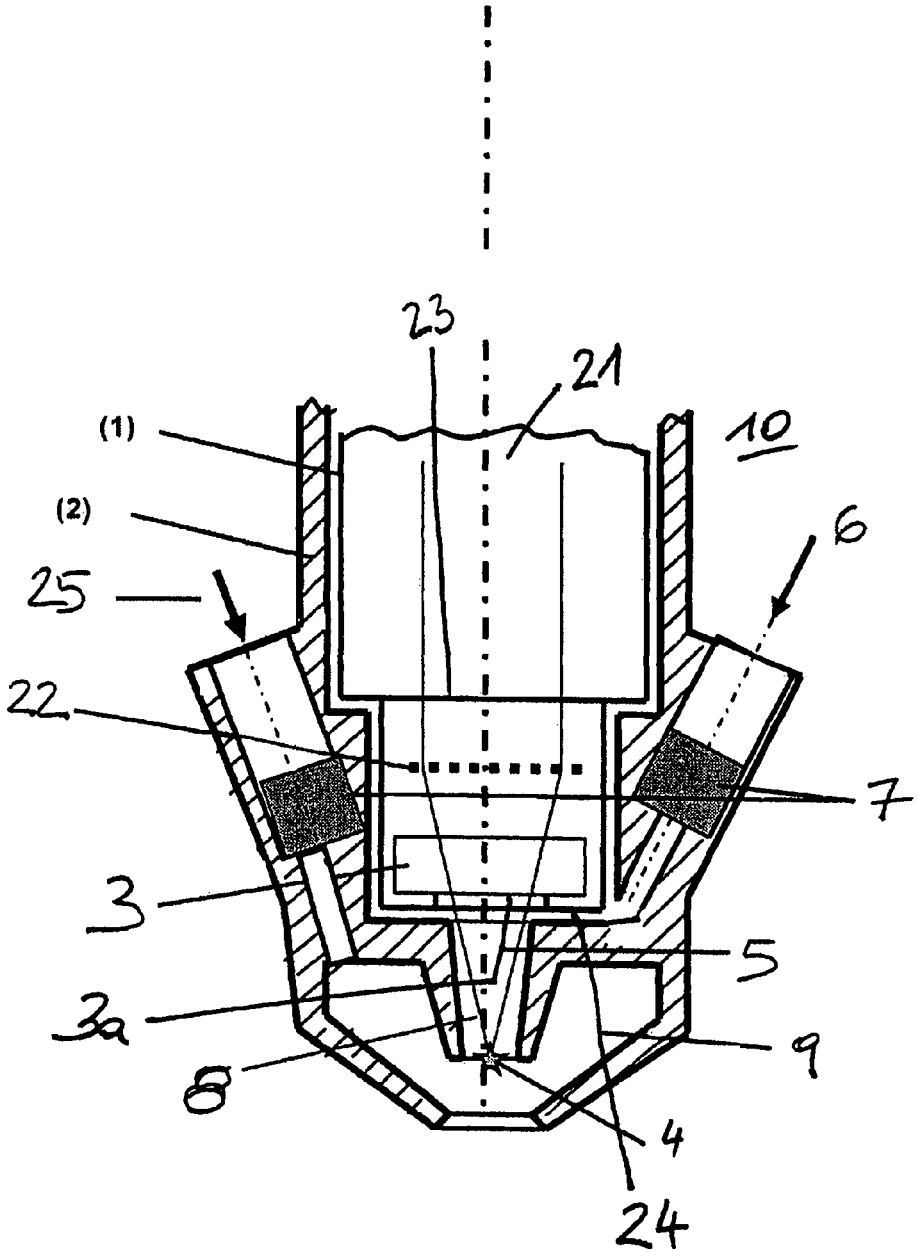
FIG. 5 shows a second embodiment with two prechambers, wherein the second prechamber is preignited to ignite the air/fuel mixture in the combustion chamber.

Finally, FIG. 5 shows a more complicated and expensive variant wherein, besides the prechamber 5, there is once again—as in the FIG. 4 variant—a second outer prechamber 9. The inner prechamber 5 is flushed with fluid to protect the combustion chamber window 3, and the outer prechamber 9 serves for optimization of mixture ignition. Unlike variant 3, the outer prechamber 9 is here flushed with fuel or fuel/air mixture 10 in order to achieve enrichment of that part of the combustion chamber. The fluid feed at the outer prechamber 9 is effected by way of a separate inlet 25. The term flushing in relation to the outer prechamber 9 does not have to signify that the entire chamber volume is flooded or flushed with fuel, fuel/air mixture or fuel-inert gas mixture, but it is also possible for a smaller volume of the outer prechamber 9 to be filled up therewith. Flushed prechambers 9 are preferably used in large-volume gas lean-burn engines as due to the ideal ignition conditions in those prechambers 9 and due to the intensive ignition beam (ignition rays) which is introduced into the main combustion chamber 11 after ignition of the prechamber volume, it is possible to burn very lean mixtures with a high degree of ignition certainty and relatively high energy conversion rates. It would however also be conceivable for the outer combustion chamber 9 to be flushed with the fluid in such a way that a flow of the fluid occurs between the combustion chamber window 3 and the focal point 4. In that case, the focal point 4 would have to be moved correspondingly further into the combustion chamber 11.

The advantage of the arrangement in FIG. 5 is that the fuel-air mixture can be ignited at the focal point 4 by means of the plasma spark in an almost stoichiometric mixture. In comparison with very lean mixtures (for example lambda $\lambda$ at =1.7), with a stoichiometric mixture only a fraction (for example 10%) of the minimum pulse energy required for mixture ignition is necessary. By way of example, it would be possible to operate here with pulse energy levels of less than 1 mJ, which not only permits very inexpensive laser systems but thereby a 'laser coating effect' could no longer occur (laser coating effect is used to denote increased fouling of the surface, at the combustion chamber side, of the combustion chamber window due to the action of laser light above a given threshold intensity and below the burning-clean intensity).

In the variant shown in FIG. 5, the focal point or the plasma spark is ignited in a region of the prechamber where the fuel-air mixture has an almost stoichiometric combustion air ratio.

In the illustrated embodiments, the fluid feed is effected by way of fluid feed devices 6 and 25. They are connected to fluid sources (not shown). The fluid feed device 6 is separate from the inlet valves or outlet valves respectively. The inlet valves in the conventional sense, in particular for the fuel, are arranged at another location in the combustion chamber. The fuel is desirably introduced to the focal point 4 or into the combustion chamber 11, but not to the combustion chamber window 3.

It can be provided for all embodiments that the laser pulse has an energy of 0.5-1.5 mJ. Thus the laser ignition system can be designed for those pulse energy levels.

The invention claimed is:

1. An apparatus for the ignition of a fuel/air mixture in a combustion chamber of a combustion machine, wherein the combustion chamber has at least one inlet valve and at least one outlet valve, wherein a laser light generating device produces laser light and a combustion chamber window introduces the laser light into a combustion chamber of the combustion machine, said apparatus comprising:

at least one fluid feed device separate from the inlet valve, said at least one fluid feed device being configured to allow a fluid to flow at least on to regions of a surface of the combustion chamber window or between the combustion chamber window and the focal point of the laser light;

a first prechamber arranged in a region between the combustion chamber window and the focal point of the laser light; and a second prechamber enclosing at least the region in which the first prechamber is arranged.

2. The apparatus as set forth in claim 1, wherein said fluid feed device has at least one fluid outlet opening.

3. The apparatus as set forth in claim 1, wherein said fluid feed device has a valve for fluid metering.

4. The apparatus as set forth in claim 3, wherein said valve is a check valve.

5. The apparatus as set forth in claim 3, wherein said valve is a metering valve.

6. The apparatus as set forth in claim 1, wherein said second prechamber is configured such that a fluid can be introduced into said second prechamber.

7. The apparatus as set forth in claim 6, wherein said fluid which can be introduced into said second prechamber is an air/fuel mixture.

8. The apparatus as set forth in claim 1, further comprising a pressure generating device for increasing the pressure of the fluid.

9. A method of operating a combustion machine, in particular a gas engine, comprising:

using a laser light generating device to introduce laser light into a combustion chamber of the combustion machine, wherein the laser light generating device has a combustion chamber window through which the laser light is introduced into the combustion chamber;

passing a fluid separate from the fuel on to the combustion chamber window or between the combustion chamber window and the focal point of the laser light in to a first prechamber located in a region between the combustion chamber window and the focal point of the laser light; and optimizing a mixture ignition and flame advance in the combustion chamber by providing a second prechamber enclosing at least the region in which the first prechamber is arranged.

10. The method as set forth in claim 9, wherein said fluid is a gas.

11. The method as set forth in claim 10, wherein said gas is air.

12. The method as set forth in claim 10, wherein said gas is an inert gas.

13. The method as set forth in claim 9, wherein the fluid is under pressure.

14. The method as set forth in claim 9, wherein said passing the fluid separate from the fuel is performed using at least one fluid feed device configured to allow a fluid to flow at least on to regions of a surface of the combustion chamber window or between the combustion chamber window and the focal point of the laser light.

15. The method as set forth in claim 9, wherein an air/fuel mixture with a $\lambda_2$ different from $\lambda_1$ in the combustion chamber is introduced into the second prechamber.

16. The method as set forth in claim 15, wherein the air/fuel ratio $\lambda_2$ in the second prechamber is lower than the air/fuel ratio $\lambda_1$ in the combustion chamber.

17. The method as set forth in claim 16, wherein the air/fuel mixture in the second prechamber is preignited by the laser light which then ignites the air/fuel mixture in the combustion chamber.

18. The combustion machine having an apparatus as set forth in claim 1.

* * * * *